US006983580B1

(12) United States Patent
Layton et al.

(10) Patent No.: US 6,983,580 B1
(45) Date of Patent: Jan. 10, 2006

(54) VARIABLE SIZE PRODUCT ON EDGE PACKAGING SYSTEM

(75) Inventors: Ken Layton, Rogers, AR (US); Jon Chandler, Springdale, AR (US); Robert Doug Robinson, Springdale, AR (US); Clyde Spinks, Cleveland, TN (US)

(73) Assignee: Delta Systems, Inc., Rogers, AR (US)

( * ) Notice: Subject to any disclaimer, the term of this patent is extended or adjusted under 35 U.S.C. 154(b) by 133 days.

(21) Appl. No.: 10/236,512

(22) Filed: Sep. 6, 2002

(51) Int. Cl.
*B65B 1/24* (2006.01)
*B65B 63/02* (2006.01)
*B65B 3/26* (2006.01)
*B65B 35/30* (2006.01)

(52) U.S. Cl. ..... 53/530; 53/153; 53/495; 198/481.1

(58) Field of Classification Search ..... 53/529, 53/530, 531, 532, 540, 153, 539, 247, 252, 53/495; 198/445, 446, 396, 480.1, 481.1, 198/433
See application file for complete search history.

(56) References Cited

U.S. PATENT DOCUMENTS 2,948,419 A * 8/1960 Seibert, Jr. ..... 414/794.9
3,537,230 A * 11/1970 Dorfmann ..... 53/529
3,645,069 A * 2/1972 Waite ..... 53/542
3,722,740 A * 3/1973 List ..... 221/7
3,745,740 A 7/1973 Williams ..... 53/26
3,831,783 A * 8/1974 Pilat ..... 414/798.8
3,849,969 A 11/1974 Paules ..... 53/74
3,959,951 A 6/1976 Paules ..... 53/162
4,162,870 A 7/1979 Storm ..... 414/107
4,173,276 A * 11/1979 Raudat et al. ..... 198/437
4,265,072 A * 5/1981 Egli ..... 53/501
5,235,796 A 8/1993 Campbell, III et al. ..... 53/535
5,480,278 A 1/1996 Morgan ..... 414/790.3
5,531,312 A * 7/1996 Dickey ..... 198/450
5,664,407 A * 9/1997 Cooper et al. ..... 53/542
5,695,041 A * 12/1997 Kouda et al. ..... 198/459.2
5,765,337 A 6/1998 Lodewegen et al. ..... 53/493
5,809,745 A 9/1998 Reinert ..... 53/447
6,052,969 A 4/2000 Hart et al. ..... 53/447
6,182,814 B1 2/2001 Koehler ..... 198/418.7
6,408,602 B1 * 6/2002 Rejcek et al. ..... 53/542

* cited by examiner

*Primary Examiner*—Stephen F. Gerrity
*Assistant Examiner*—Paul Durand
(74) *Attorney, Agent, or Firm*—Head, Johnson & Kachigian

(57) ABSTRACT

A device and method for stacking and packaging cylindrical products having variable size. Products are placed on edge and organized to a uniform stack size by means of a product compressing drum. The stack is placed in a trough between a cam operating front lug and a back lug. Once between lugs, the uniformly sized stack maybe packaged into uniform size packages.

10 Claims, 4 Drawing Sheets

VARIABLE SIZE PRODUCT ON EDGE PACKAGING SYSTEM

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A SEQUENCE LISTING, A TABLE OR A COMPUTER PROGRAM LISTING COMPACT DISC APPENDIX

Not Applicable.

BACKGROUND OF THE INVENTION

1. Field of the Invention

The present invention relates to an apparatus and method for stacking multiple products that do not have a uniform size. More specifically, the apparatus and method stacks products of varying horizontal size utilizing a design that allows for packaging objects of varying size into packages of a single standard size. The apparatus and method is fast, efficient and reliable.

2. Prior Art

Pastries are a multi million dollar a year business in the United States. The manufacture and sale of donuts is especially lucrative. Many companies package their donuts for later sale in grocery stores or super markets. Unfortunately, packaging donuts has proven very problematic. Because donuts and other pastries rise during baking, end products are not uniformly shaped. Automated packaging machinery typically requires products having precise, uniform shapes. This had caused a development of suitable donut packaging machinery to be very problematic. Because they are of varying size and shape, they generally cause packaging machines to become clogged and the donuts to become smashed or malformed.

Currently systems that automatically handle products of a fairly uniform shape and size exist. In the food industry, a good example of this type of product is a sandwich cookie. There is a large amount of prior art that deals with the handling of these uniform types of products. Despite numerous attempts, efforts to use these systems with products that have a large variation in size have been a total failure. Because of these failures, these variable size products are loaded into the horizontal wrapper, or other secondary system, by hand. This is very costly and labor intensive.

There have been several attempts in the past to develop machines capable of stacking and packaging multiple donuts.

U.S. Pat. No. 3,745,740 to Williams discloses a packaging method and apparatus that stacks donuts and other objects having similar shapes. The patent discloses a method of stacking donuts by dropping them into a cylinder. A moving rod then lowers a stack of donuts into a package. The objects are stacked vertically, not horizontally. This patent does not disclose the use of a rotating drum having successive wells in it.

U.S. Pat. No. 4,162,870 to Storm discloses a device to horizontally stack donuts and similar products. A lever lifts objects onto their edge and places them in a horizontal stack held in place by lever arm and a piston. It then drops the objects into a package. It does not disclose the use of a rotating drum to package donuts.

U.S. Pat. No. 5,480,278 to Morgan discloses a apparatus and method for stacking frozen patties and other objects having similar shape. A conveyor belt moves the patties onto a piston. After a pre-determined number of patties are rested upon the piston, the piston moves upward to a horizontal platform where they are pushed off the piston. This process is then repeated. The frozen patties are stacked vertically, not horizontally. Furthermore, the stacking action is not continuous. When the piston moves up to the horizontal platform. The stacking action must stop, requiring a discontinuous, slower process. This patent does not disclose the use of a rotating drum to stack objects having variable sizes.

U.S. Pat. No. 5,809,745 to Reinert discloses another method for vertically stacking frozen patties and similar objects. This invention uses a rotating cam to lift objects to the bottom of a stack. The objects are vertically stacked and are not on edge. Stacking from the bottom up, as shown in this patent is not suitable for soft objects such as donuts and pastries. Such stacking action would result in the crushing of the product. Furthermore, the patent does not disclose a rotating drum for packaging donuts.

U.S. Pat. No. 5,765,337 to Lodewegen et al., discloses another method for vertically stacking cylindrical objects. It provides for vertically not horizontally, stacked items. It also does not disclose the use of a rotating drum to stack variable size objects.

U.S. Pat. No. 6,182,814 to Koehler discloses a method of separating a continuous row of on-edge objects into smaller groups. It uses a vacuum and slugs to separate objects that are already on edge. While the objects are horizontally stacked, it does not disclose the use of a rotating drum to accomplish this.

U.S. Pat. No. 6,052,969 to Hart et al., discloses a method of stacking cylindrically shaped products. A conveyor belt drops the objects into a stacker thereby placing them on edge. Once the stacking device is full, it transfers the stack to a package. The invention disclosed in this patent is most suitable for hard objects such as frozen patties. Soft objects, such as donuts and pastries, would not stack properly in this device and would probably be significantly damaged. This device does not disclose the use of a rotating drum to package cylindrical objects.

U.S. Pat. No. 3,849,969 to Paules discloses a device that individually wraps frozen patties prior to their being stacked on pistons. The patties are stacked vertically, not horizontally. In addition, this device is only suitable for relatively sturdy objects such as frozen patties. Softer objects, such as donuts would be damaged by such a machine. It also does not disclose the use of a rotating drum to package cylindrical objects.

U.S. Pat. No. 3,959,951 to Paules discloses an apparatus very similar to the one described in the preceding paragraph. It is suitable only for vertically stacking frozen patties. It would be damaging to softer products. It also does not disclose the use of a rotating drum to package products on edge.

U.S. Pat. No. 5,235,796 to Campbell, III et al., discloses a method for stacking and packaging small planar objects such as cookies and crackers. A conveyor belt dumps the objects onto a machine designed to vertically stack them. Once the stacking unit is full, it pivots downward and releases the objects into a package. Arms on the stacking unit rotate outward to allow the stacked objects to be released into the package. The pivoting motion of the stacking unit requires that the packaging be performed in a discontinuous fashion. Stacking must stop when the stacking unit places objects into a package. This patent also does not provide a method of stacking objects of variable size into a standard size package. This patent also does not disclose the use of a rotating drum to provide for continuous packaging.

BRIEF SUMMARY OF THE INVENTION

The product on edge packaging system takes product delivered on its side in random fashion and turns it on edge, organizes it into product groups and feeds it into a horizontal packaging system, or any other secondary system. The system is unique in its ability to handle product that varies in size greatly with no adjustments or modifications. The system is also ideal for handling soft and delicate items because of the gentle action of the feeding system.

The present invention discloses an improved method for stacking and packaging cylindrically shaped, variable size products. A key feature of the invention is a rotating drum used to organize donuts or other variable size, cylindrical objects into a product group of uniform size. As the drum rotates, donuts located in wells in the drum formed into a product group of uniform length. They are rotated into a trough where two lugs hold the horizontally stacked product group in a uniform size. They are then passed through packaging machinery that packages the donuts or other products in packaging of uniform size.

Another important feature of the present invention is the manner in which the lugs catch the horizontal product stack. The front and rear lugs operate on separate chain drives. The front lug drive has a cam that causes the front lug to be delayed in entering the trough. The front lug is precisely timed such that it enters the trough and rapidly catches the forward end of the product stack as it exits the rotating drum. One feature of the present invention is the fact that the front lug never enters the drum as the rear lug does. This prevents damage to the product stack and also allows the invention to operate more rapidly. The front lug is timed such that it will not damage the stacked products. One of the difficulties found in the prior art is that lugs in other items utilized to hold a product stacked during packaging will often inadvertently damage one or more of the products. The camming action of the present invention overcomes this deficiency.

In the present invention, the products leave the oven or other cooking machinery lying flat. They are conveyed by any number of means to a series of lanes having slots within them. The edges of the products fall within these slots, causing them to turn such that they are on edge. A short conveyor then feeds the products into wells within a rotating drum. As the drum rotates, the products are moved closer together. Once the drum has rotated such that the products are lying within a trough, the product group has been slightly compressed such that the horizontal stack is of a uniform length. The front and rear lugs then grasp the stack and move it down the trough. The drum rotates again and the process is repeated. This process of utilizing a rotating drum greatly increases the speed and efficiency with which donuts and other cylindrical, variable size products may be packaged. Current methods described in prior art patents and methods of packaging by hand are far less efficient.

The present invention may be enhanced by adding optional features. These include a photo eye designed to verify that products have fallen into the wells of the drum prior to its rotation. Another option is the use of a placement finger, that insures that a product has fallen into a well in the drum.

Any number of suitable conveying means may be used to introduce the cylindrical products of the device. Conveyor belts, rollers and vibrating boards are all suitable methods known to those skilled in the art.

DETAILED DESCRIPTION OF THE INVENTION

In the present invention, a delivery system presents cylindrically shaped product onto a vibratory pan to spread the product out. The product is then introduced to lanes in which they are turned on edge. They are then fed into product wells in a rotating drum. Working vanes about the drum and tapered side walls facilitate formation of a product group having a uniform length. Leading and trailing lugs then hold and guide the product group into any of a number of packaging systems known in the art.

Figure 1:
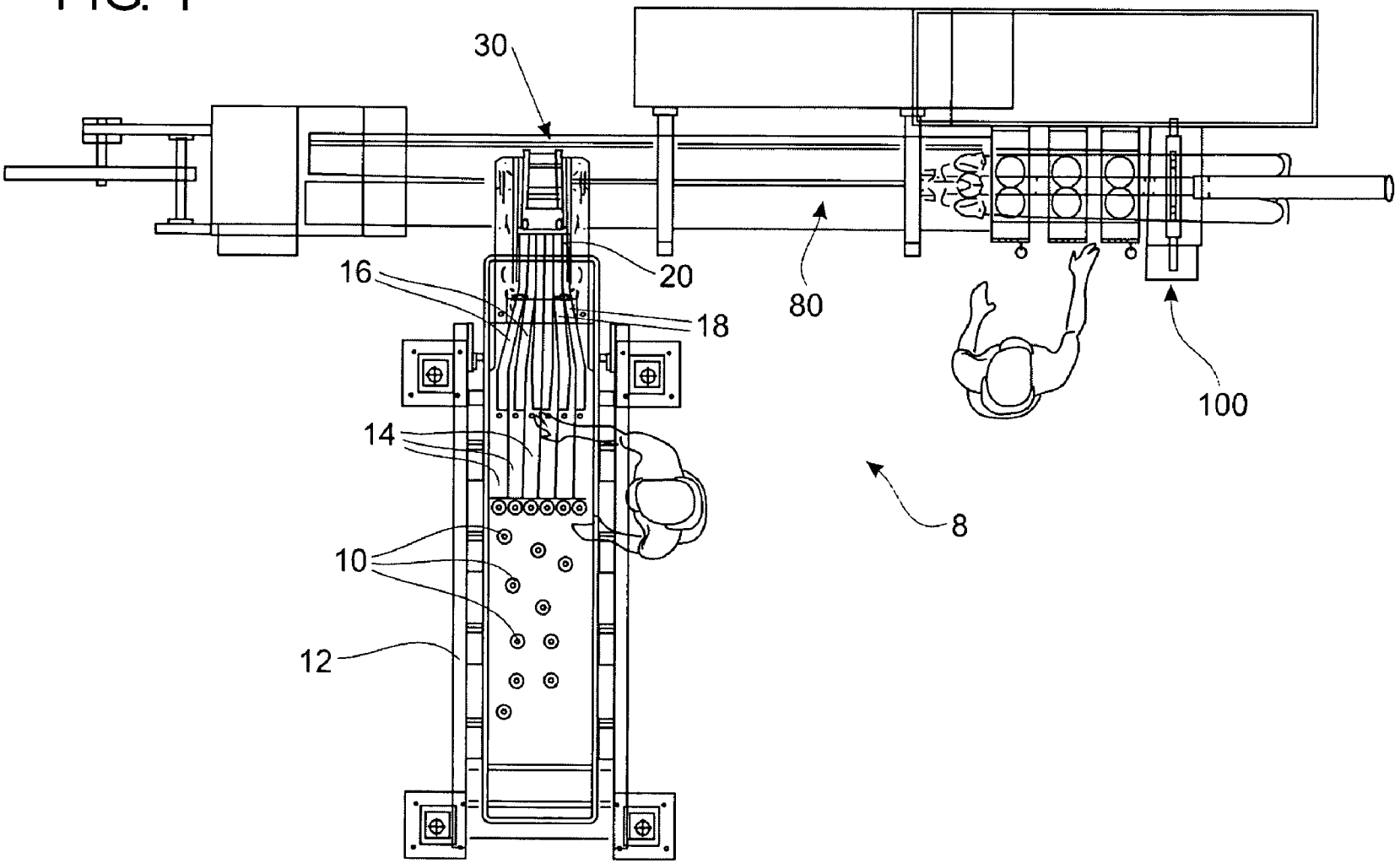
FIG. 1 is a top down diagrammatic view of the present invention.

FIG. 1 shows a diagrammatic overview of the present invention. The product 10 is emptied onto vibratory feeding system 12 by any of a variety of delivery systems. Vibratory feeding system 12 spreads the product 10 out to a single level by the natural vibrating action of the pan. The term "product" is used herein to describe cylindrically shaped items having varying size. This action evenly distributes the product 10 to the multiple lanes 14. The vibratory conveyor 12 uses an oscillating action rather than electromatic shaking. This is important because it provides for a much more gentle feeding action. Many products, such as donuts, are relatively fragile and easily damaged. Use of a gentler, oscillating motion prevents damage of product 10. However, those skilled in the art will appreciate that the invention may be used for a more durable products in which use of oscillating rather than electromatic action is unnecessary.

The product advances down the lanes 14 on the vibratory pan 12. Further down lanes 14 have slots 16. Slots 16 are formed by removing one half of the bottom of slots 14. One side of the product 10 in lanes 14 will fall into slot 16, causing the product to turn onto its side. Slots 16 are then tapered together so that they form a series of on edge lanes 18. Conveyor belt 20 moves product 10 through on edge lanes 18 until they reach rotary drum 30. Conveyor belts 20 facilitate entry of product 10 into rotary drum 30 and are optional. They may be replaced with lanes having a greater slope, thereby allowing gravity to pull the product 10 toward rotary drum 30. Utilizing slots 16 to turn a product on edge is an established technology well known in the art for turning various products on edge in packaging systems.

Figure 2:
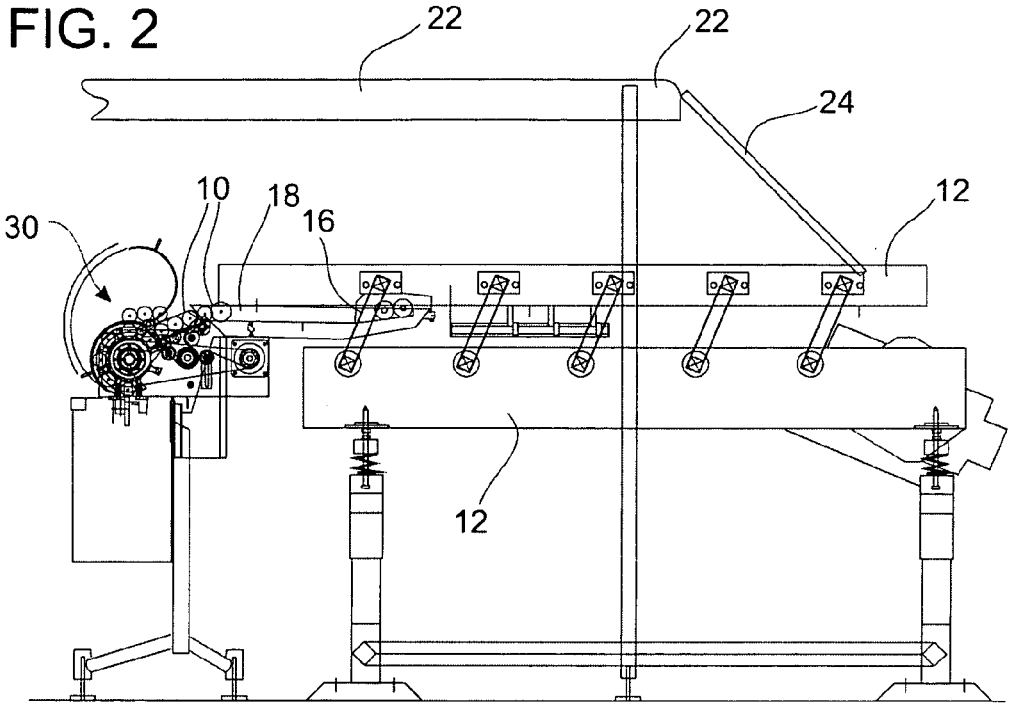
FIG. 2 is a diagrammatic side view of the present invention.

FIG. 2 illustrates a side view of the present invention. Delivery system 22 delivers product to ramp 24 which subsequently delivers product to vibratory pan 12. Delivery system 22 may be any other number of delivery system known to those skilled in the art including, but not limited to, vibratory conveyors, bucket conveyors and conveyor belts. Vibratory pan 12 spreads out the product which then falls on its edge in slot 16. On edge lanes 18 are slightly inclined up to reduce the back pressure of accumulated product. On edge lanes 18 are tapered in order to form a tight group of on edge products to be delivered to drum 30.

Figure 3:
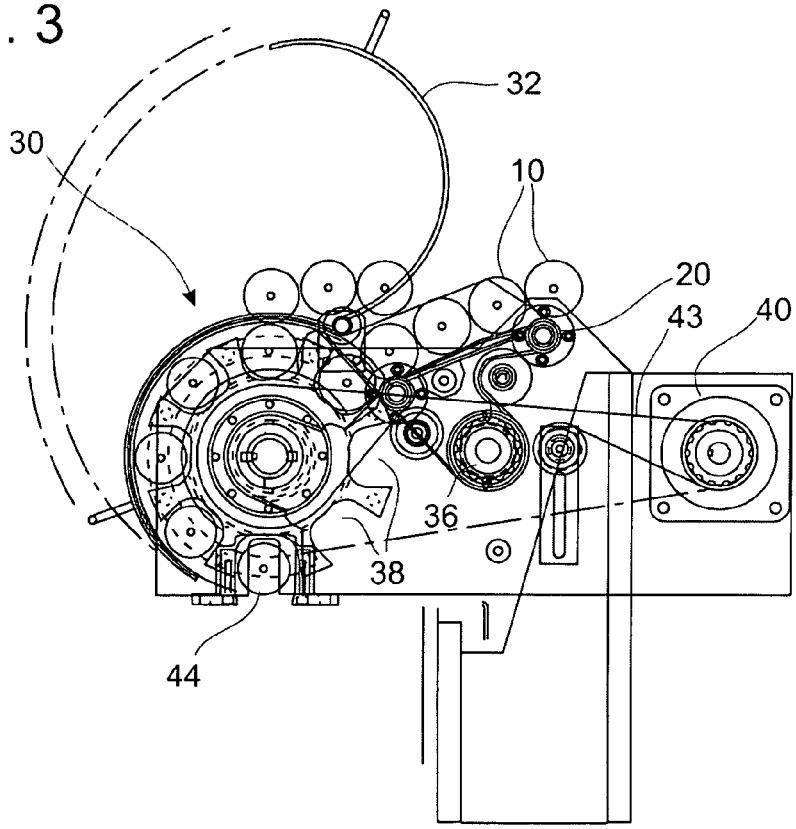
FIG. 3 is a cross sectional diagrammatic side view of the rotational drum of the present invention.

FIG. 3 shows a close up side view diagrammatic illustration of rotary drum 30. Rotary drum 30 has a shield 32 to prevent product 10 from falling out of rotary drum as it rotates. Shield 32 may be placed in either a closed or open position. Servo motor 36 operates conveyor belt 20 which moves product 10 into wells 38 located about the circumference of rotary drum 30. Conveyor belt 20 provides for smoother motion than an oscillating vibratory pan. This eases the insertion of product 10 into wells 38. As mentioned above, conveyor belt 20 and servo motor 36 may be replaced with a lane having a steeper slope. This will allow gravity to move product 10 into wells 38. This may decrease the cost of producing the present invention, as well as reduce the number of moving parts, and therefore the number of things that can break and halt packaging of the product. Rotating drum 30 has several rows of parallel wells in order to form multiple product groups. Servo motor 40 operates belt 43 which causes drum 30 to rotate. Once every well in a parallel row is filled, drum 30 rotates such that an empty well is in position to receive product 10. Once a row of products in parallel wells reaches interposing region 44 within a trough, leading and trailing lugs will grab the product group and move it to a standard packaging system.

Figure 4:
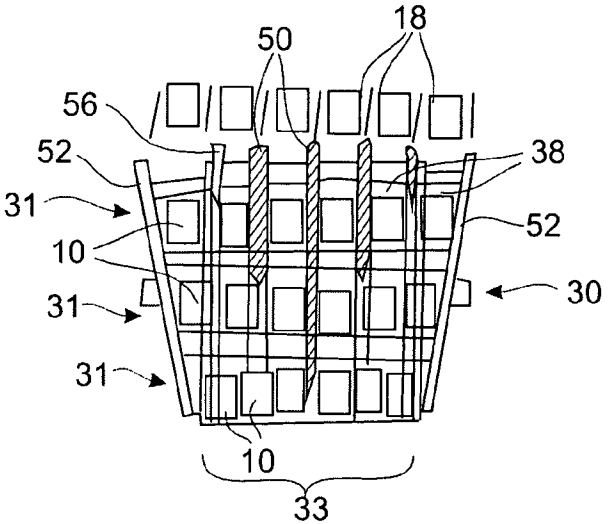
FIG. 4 is a front diagrammatic view of the rotational drum of the present invention.

FIG. 4 shows a front diagrammatic view of drum 30. In this particular embodiment, there are six on edge slot lanes 18 feeding rotating drum 30. Products 10 are placed within product wells 38 that are aligned in parallel rows. Vertical separator vanes 50 extend into the drum 30 in an arc around the drum to maintain product separation and prevent the individual products from falling over. These vanes are important in the function of the drum feeder. By separating the products at the drum load location, they allow the product 10 to fall into a well 38 that is larger in every dimension than the maximum allowable size of the product 10. At this maximum size, if the products fell into a pocket without separator veins 50, the resultant large composite area would allow the product to fall over unless all the products were near the maximum allowable size. The resultant multi-piece product group of products is formed by side plates 52 that push the outside products toward the center. As this compression is taking place, separator vanes 50 end in sequence from the outside in. The final center vane is ended only after the product group is fully compressed by tapered side plates 52. By this action, products 10 are prevented from falling over during the rotating, stack forming process. Tapered side plates 52 are important to the present invention. They organize the products into a product group of uniform length. In order to do this, the product group is pushed together. However, this compression is very slight, as donuts and other products are very fragile. The forces exerted upon the product group by the tapered side panels and the lugs is only great enough to hold them in place. Those skilled in the art will appreciate that the tapered side panels and lugs may be adjusted for different size products to insure that only enough force to hold the products group in place is exerted upon the product group.

Without vanes 50, rotary drum 30 would not be able to handle the range of product sizes it does. This particular embodiment shows a drum designed to form a product group 33 of 6 products 10. However, those skilled in the art will appreciate that a drum may be shortened or lengthened to accommodate any size product group. For donuts, it is especially desirable to form product groups of 6. For other products, it may be desirable to stack them in groups of 10 or more.

Figure 5:
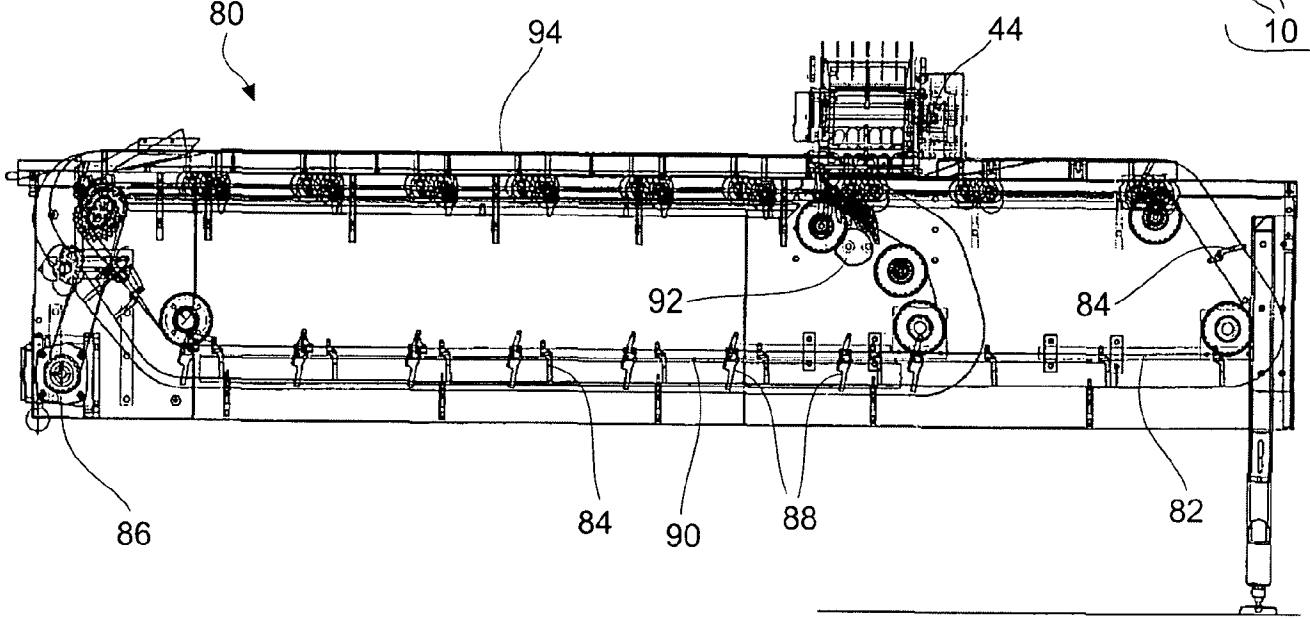
FIG. 5 is a diagrammatic view of the lug system of the present invention.

Once the products have been formed into product group, they are ready to be removed from the rotary drum and packaged. In order to do this, the product group is rotated into the lug and drum interposing area 44 as shown in FIG. 5. A lug system removes the product group and moves it down a trough to a packaging system. The interposing action is critical to the proper functioning of the system. A series of trailing lugs 84 are attached to a trailing lug chain 82 that is driven by motor 86. This trailing lug 84 pushes the product group from the drum. The leading lug, on the other hand, never passes through any part of the drum pocket. This is possible because leading lugs 88 travel on chain 90 that follows a shorter path than trailing lug chain 82. Leading lugs 88 are capable of a special camming action causing them to pivot down using stationary cam 92 to prevent interference with the product within interposing position 44. Because of product variance in size, the products will not fall from the rotary drum with any consistency. Therefore the products must be removed by the positive action provided by trailing lugs 84. Front lug 88 must always be in front of the multi pack stack to prevent the products from falling over. Simply pivoting the front lug 88 down to clear the drum would be significantly less efficient because the necessary horizontal motion of front lug 88 would prevent trailing lug actuation until the front lug had fully cleared the drum pocket. The combination of vertical and horizontal movement of the front lug 88 provides support for the group during the critical drum rotation. This design also eliminates the need for excessively fast drum rotation. If the leading and trailing lugs followed the same path, the drum would have to rotate at a much higher speed to cycle between the two lugs. This would greatly eliminate the speed at which the drum lug system could operate. The present invention as currently designed allows the drum rotation to take up to one third of the total cycle time between lugs. The result is a system that is limited in speed only by the force of gravity that initially forces the product into the drum product wells. The dual lug system is designed such that the distance between leading lug 88 and trailing lug 84 may be adjusted.

The combination of the front lug camming system with a rotating drum provides for a highly efficient method of packaging variable size products on edge. The lugs carry the product groups down trough 94 which leads them to any of a number of packaging systems known to those skilled in the art. The significance of the present invention lies in the ability to form stacked variable size product groups that will fit into uniformly sized packages.

Figure 6:
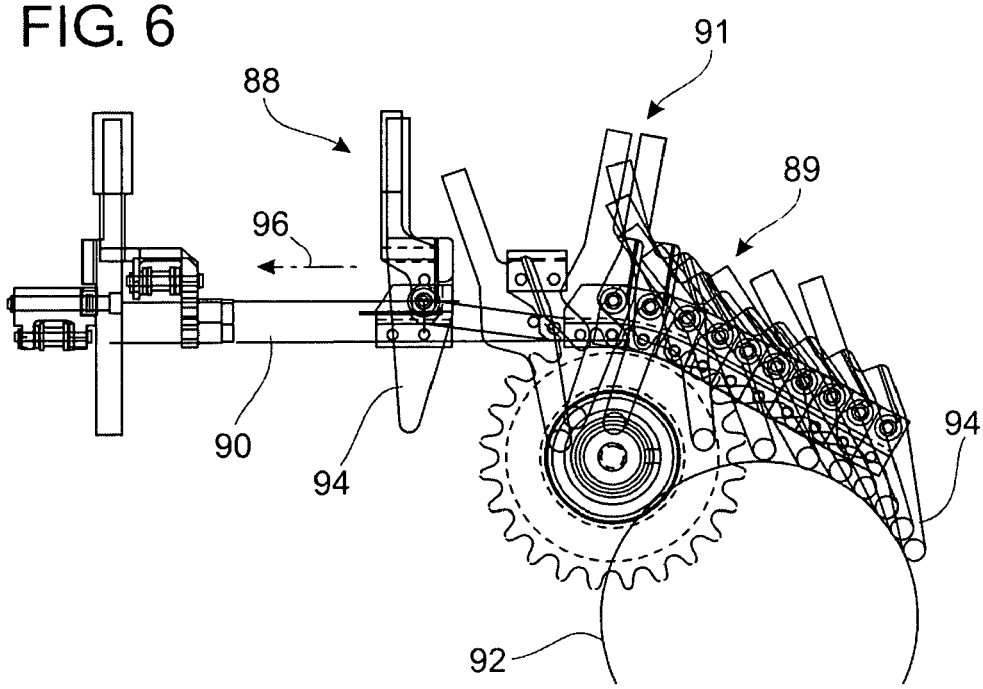
FIG. 6 is a diagrammatic illustration of the camming motion of the lug system.

FIG. 6 illustrates the mechanism by which front lugs are pushed down by stationary cam 92 and subsequently allowed to pop up directly in front of the product group. Stationary cam 92 engages cam arm 94 that extends downward from leading lug 88. As leading lug track 90 pulls cam 88 in the direction of directional arrow 96, leading lug 88 is moved into horizontal position 89 as it remains engaged to stationary cam 92. Once a leading lug 88 has passed over stationary cam 92, it immediately springs back into vertical position 91. This action allows leading lug 88 to spring into the trough and catch the forward end of product group in order to prevent products from falling over. It also allows leading and trailing lugs to retain the length of the product group so that they may be packaged in a uniformly sized package.

Figure 7:
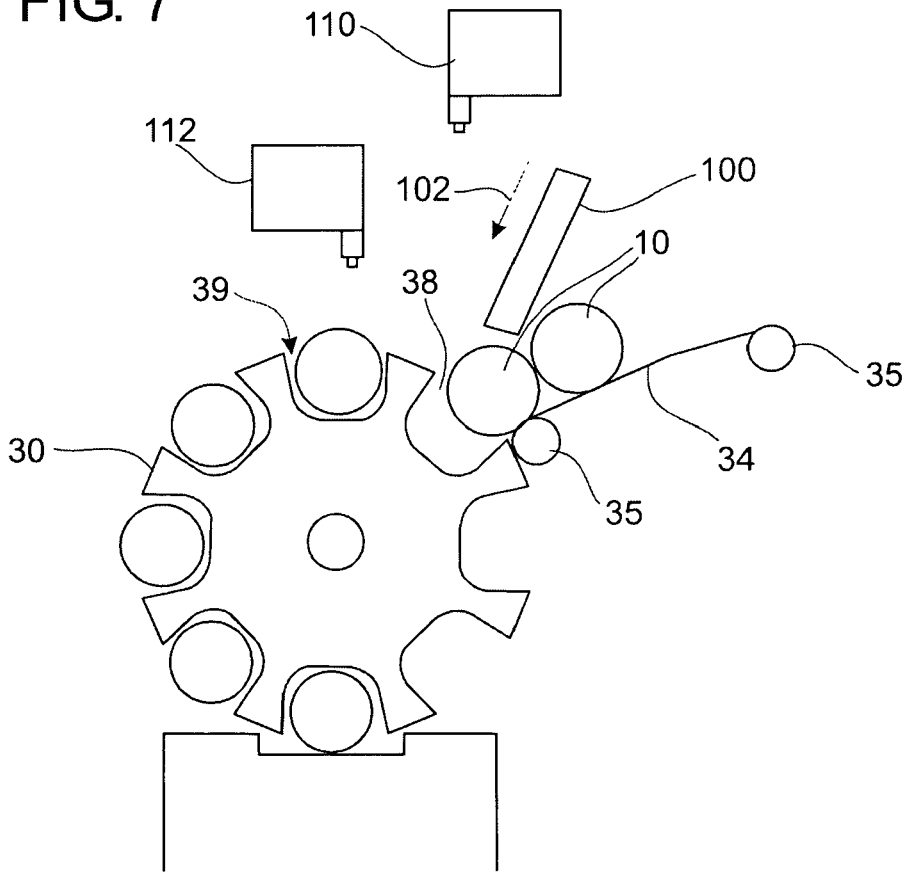
FIG. 7 is a diagrammatic view of the rotational drum of the present invention including additional, optional components.

Various optional features may be added to the present invention to enhance its efficiency. Some of these features are illustrated in FIG. 7. Some products 10, such as chocolate donuts, often stick to one another. This is illustrated in FIG. 7 by products 10 which are stuck together. This hinders the ability of products 10 to flow into well 38 of drum 30. This can slow down the machine and require the intervention of human operators. To overcome this difficulty, prodding finger 100 may be added to the design of the invention. Prodding finger 100 is located just above well 38 into which product 10 is to be placed. Prodding finger 100 moves in the direction of directional arrow 102. This action jars product 10 loose from any other products to which it is stuck. The action of prodding finger 100 is relatively gentle and will not damage even delicate products such as donuts.

Also shown in FIG. 7 is photo eye 110, aimed at the well into which a product is being placed. When the photo eye detects that a product 10 has been successfully placed into well 38, it will signal electronically that it is permissible for the drum to rotate and a new well to be filled with product. If no product is detected by the photo eye, the drum will remain un-rotated until it detects a product. A prodding finger and/or photo eye is preferably placed in line with each well of a parallel row of wells along the side of a drum. This will insure that every product group has the same number of products.

Photo eye 110 looks into the wells 38 into which the product is being placed and signals the invention to rotate drum 30 once all of the wells are filled. However, for a variety of factors, photo eye 110 may misread whether a well is filled. This is because there are a many moving parts in the vicinity of well 38 and sticky products may move partially into a well, but not remain there. To insure that all product stacks have the appropriate number of products, photo eye 112 may also be added to look into well 39. For each well 39, there will be a corresponding photo eye 112. If any of the photo eyes 112 detect that a well is empty, it will signal the packaging machine of the present invention to stop so that the defective product group may be removed. This prevents the formation of product stacks having fewer than the desired number of products.

FIG. 7 also illustrates use of a loading ramp 34 in place of the conveyor belt 20 shown in FIGS. 1 and 3. Loading ramp 34 is set at an angle steep enough to allow gravity to exert sufficient force to pull products 10 into wells 38 without damaging them. Those skilled in the art will appreciate that the maximum allowable angle will depend on how sturdy the product is. For example, frozen meat patties could be loaded on a loading ramp have close to 90° while donuts would be loaded at a significantly smaller angle because they are relatively fragile. Loading ramp 34 is attached to the rest of the invention by braces 35.

Whereas, the present invention has been described in relation to the drawings attached hereto, it should be understood that other and further modifications, apart from those shown or suggested herein, may be made within the spirit and scope of this invention.

What is claimed is:

1. An apparatus for organizing variable size on edge products into a product group having a predetermined length comprising:

at least two lanes capable of placing variable size cylindrical products on edge and next to one another;

a rotatable drum having at least one row of parallel product wells, a circumference, and two ends;

at least one arcing vane in between said parallel product wells to prevent damage or crushing of products on edge during the compressing process;

tapered side panels on both ends of the rotating drum capable of organizing products within the drum's wells into product groups as the drum is rotated a dual lug system capable of removing compressed products on edge from the rotatable drum;

wherein said dual lug system comprises a trailing lug for actuating removal of said compressed product group and a leading lug capable of camming action.

2. The apparatus of claim 1 further comprising a vibratory pan capable of feeding products to said at least two lanes.

3. The apparatus of claim 1 wherein said rotatable drum has a plurality of parallel rows of wells about its circumference such that each row of wells may be utilized to compress a product group to uniform size.

4. The apparatus of claim 1 wherein said row of parallel product wells comprises six wells.

5. The apparatus of claim 4 wherein said vanes comprise 5 parallel vanes wherein the central vein is the longest.

6. The apparatus of claim 1 further comprising photo eyes to detect when products have entered every well in the rotatable drum.

7. The apparatus of claim 1 further comprising prodding fingers to facilitate the placing of on edge products into the wells in the rotatable drum.

8. An apparatus for compressing variable size on edge products into a product group having a predetermined length comprising:

at least two lanes capable of placing variable size cylindrical products on edge and next to one another;

a vibratory pan capable of feeding products to said at least two lanes;

a rotatable drum having a plurality of rows of six parallel product wells, a circumference, and two ends;

five arcing vanes in between said wells to prevent damage or crushing of products on edge during the compressing process;

tapered side panels on both ends of the rotating drum capable of compressing products with the drum's wells as the drum is rotated;

a dual lug system capable of removing compressed products on edge from the rotatable drum;

wherein said dual lug system comprises a trailing lug for actuating removal of said compressed product group and a leading lug capable of camming action.

9. The apparatus of claim 8 further comprising photo eyes to detect when products have entered every well in the rotatable drum.

10. The apparatus of claim 8 further comprising prodding fingers to facilitate the placing of on edge products into the wells in the rotatable drum.

* * * * *